United States Patent [19]

Riddle

[11] Patent Number: 4,721,187

[45] Date of Patent: Jan. 26, 1988

[54] LIFT TRUCK MAST STRUCTURE

[75] Inventor: Ernest J. Riddle, Branchton, Canada

[73] Assignee: The Raymond Corporation, Greene, N.Y.

[21] Appl. No.: 29,249

[22] Filed: Mar. 23, 1987

[51] Int. Cl.[4] ..... B66B 9/20

[52] U.S. Cl. ..... 187/9 E; 414/631

[58] Field of Search ..... 187/9 E, 9 R; 414/629, 414/630, 631; 254/342, 389, 264

[56] References Cited

U.S. PATENT DOCUMENTS 3,394,778 7/1968 Brinton ..... 187/9 E 4,657,471 4/1987 Shinoda et al. ..... 187/9 E

*Primary Examiner*—Joseph J. Rolla

*Assistant Examiner*—Kenneth Noland

*Attorney, Agent, or Firm*—Richard G. Stephens

[57] ABSTRACT

The present invention provides an improved telescopic mast structure for a hydraulically operated lift truck. The mast structure of the present invention has reeved hydraulic hoses which do not obstruct the operators view and a chain connecting the inner and outer telescopic sections so that inner telescopic section moves at twice the speed of the outer telescopic section. This chain is located inside a U shaped channel element that forms the mast mainframe. The U shaped channel that forms the mast mainframe fits around the I shaped elements that support the two telescopic sections and the chain interconnecting the telescopic sections is in front of the I member of the outer telescopic section and alongside of the front part of the I member of the inner telescopic section. The chain interconnecting the telescopic sections is therefore in a protected location and most important it does not add any length to the vehicle.

6 Claims, 5 Drawing Figures

LIFT TRUCK MAST STRUCTURE

The present invention relates to material handling apparatus and more particularly to lift trucks.

BACKGROUND AND PRIOR ART

Lift trucks having hydraulically actuated telescopic masts are well known. For example, such trucks are manufactured and commercially marketed by the Raymond Corporation which is located in Greene New York and which has distributors throughout the United States and in several foreign countries.

A lift truck can be operated more rapidly and safely if the operator has as much unobstructed space in front of him as possible. The operator's visibility in a lift truck with telescopic mast sections is sometimes impeded by the presence of the hydraulic hoses which are necessary to supply pressurized oil to the cylinders on the fork carrier.

It is known that operator visibility can be improved by the use of a mast structure which has reeved hoses which are threaded over pulleys located on the top of the two movable mast sections. In such a mast structure the movable mast sections must be interconnected so that the inner telescopic section and the outer telescopic section move synchronously, thereby avoiding the application of undue tension on the reeved hoses. In a prior art system, the movement of the inner and outer telescopic sections is synchronized by means of a chain that is connected between the inner (i.e. upper) telescopic section and the fixed mast or truck main frame, with an idler sprocket connected to the outer (i.e. lower) telescopic section. As a result of this connection, the outer telescopic section is forced to move at one half the speed of the inner telescopic section. Stated differently, the relative speed of motion between the inner telescopic section and the outer telescopic section equals the relative speed between the outer telescopic section and the fixed mast. The hydraulic hoses have fixed connections to the bottom of the mast mainframe and to the bottom of the inner telescopic section, and they are reeved over idler pulleys which are journaled to the top of the outer telescopic section. Thus, the hoses remain taught.

A disadvantage associated with this prior art system is that the chain which interconnects the telescopic sections is positioned behind the mast, and in order to prevent the cross ties on the telescopic sections from interfering with the operation of the chain, the cross ties are positioned behind the chain. This structure undesirably increases the length of the overall lift truck.

The length of a lift truck is a very important characteristic of a lift truck, since turning radius is directly related to length. The productivity of a truck and operator is directly related to the turning radius of the truck. The elimination of one or more inches in the length of a truck therefore has significant economic significance.

OBJECTS OF THE INVENTION

An object of the present invention is to provide an improved structure for the mast of a lift truck.

Another object of the present invention is to provide a structure for the mast of a lift truck which gives the lift truck operator improved visibility.

Still another object of the present invention is to provide an improved lift truck which has a relatively short overall length. Yet another object of the present invention is to provide a relatively short lift truck which has improved operator visibility.

Still another object of the present invention is to provide a relatively short lift truck which has reeved hoses on the mast.

SUMMARY OF THE INVENTION

The present invention provides an improved telescopic mast structure of a hydraulically operated lift truck. The mast structure of the present invention has reeved hydraulic hoses which do not obstruct the operator view and a chain connecting the inner and outer telescopic sections so that inner telescopic section moves at twice the speed of the outer telescopic section. This chain is located inside a U-shaped channel element that forms the mast mainframe. The U-shaped channel that forms the mast mainframe fits around the I-shaped elements that support the two telescopic sections and the chain interconnecting the telescopic sections is in front of the I-member of the outer telescopic section and alongside of the front part of the I-member of the inner telescopic section. The chain interconnecting the telescopic sections is therefore in a protected location and most importantly it does not add any length to the vehicle.

The foregoing and other objects, features and advantages of the invention will be apparent from the following more particular description of preferred embodiments of the invention, as illustrated in the accompanying drawings.

DETAILED DESCRIPTION OF AN EMBODIMENT OF THE INVENTION

Figure 1:
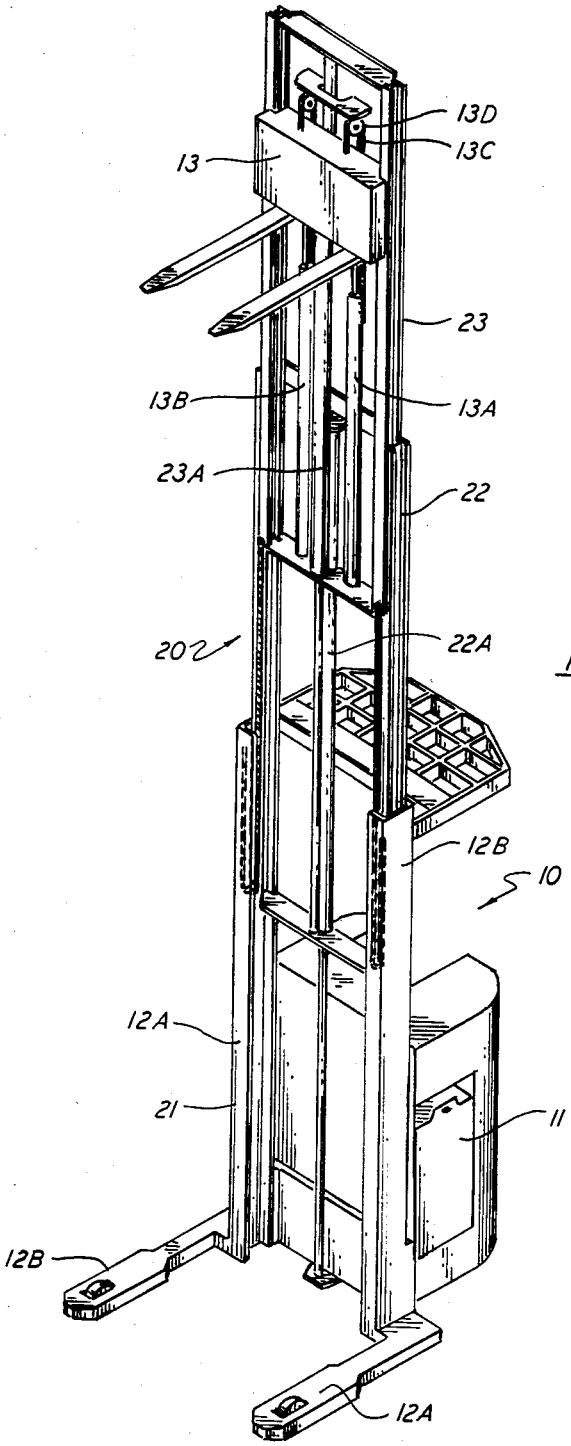
FIG. 1 is an overall view of a lift truck built in accordance with the present invention.

The structure of a lift truck with the present invention is shown in FIG. 1. It incudes an operator station 10, a battery 11, outriggers 12A and 12B, a fork carriage 13, and a mast 20.

Mast 20 incudes a mainframe base section 21, and two movable sections 22 and 23. Section 22 is referred to as the outer telescopic section and it is moved by hydraulic cylinder 22A. Section 23 is called the inner telescopic section and it is moved by hydraulic cylinder 23A.

Figure 2:
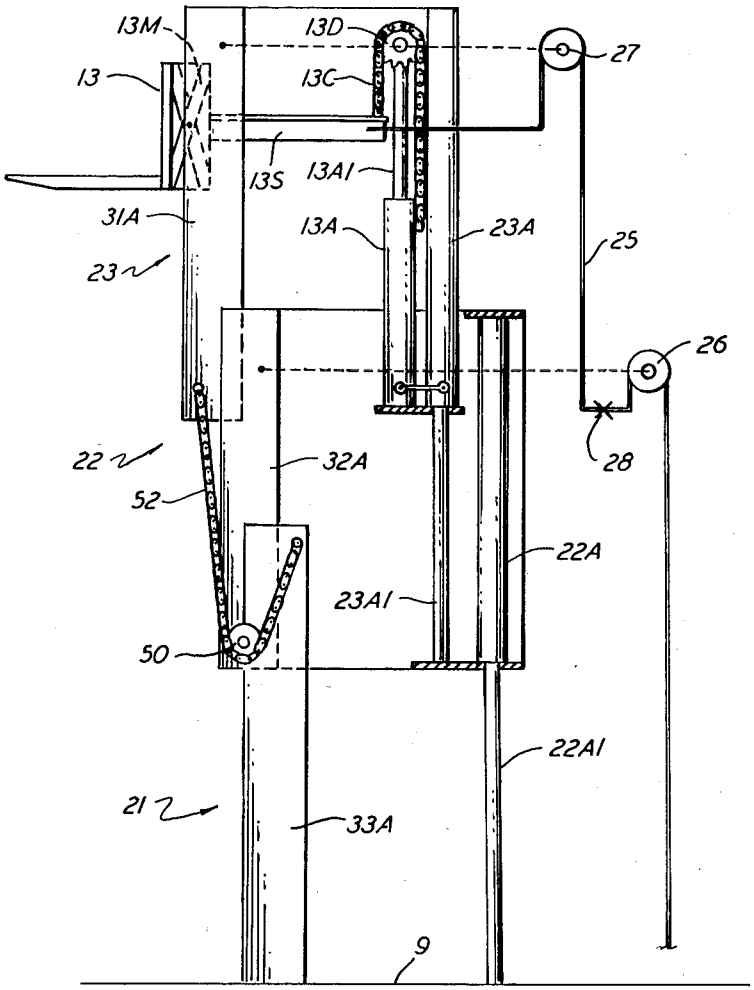
FIG. 2 is an exploded schematic side view showing in side by side relationship, the telescopic sections, the hydraulic cylinders and the reeved hydraulic hoses.

FIG. 2 is an exploded-side-schematic, diagram of the elements in mast 20. It is necessary to understand the interrelationship of these elements in order to understand the present invention; however, most of the elements are standard elements available in commercially available lift trucks, hence, they are only explained in sufficient detail to provide a basis for understanding the present invention.

As shown in FIGS. 1 and 2, the fork carriage 13 is movably mounted on the inner telescopic section 23 and it is moved by hydraulic cylinders 13A and 13B via chains 13C which pass over pulleys 13D. The fork carriage 13 is moved via chains 13C so that it can be lowered to ground level. A first hydraulic cylinder 22A is used to lift the outer telescopic section 22, and another hydraulic cylinder 23A is used to lift inner telescopic section 23; however, two hydraulic cylinders 13A and 13B are used to move fork carriage 13. Two cylinders are used to move fork carriage 13 in order to compensate for the mechanical disadvantage introduced by chains 13C and pulleys 13D and to make the forces on all of the hydraulic cylinders substantially equal.

Fork carriage 13 includes hydraulic cylinders 13S to actuate the reach mechanism 13M. A hydraulic hose 25 supplies hydraulic fluid to cylinders 13S. Hydraulic hose 25 is reeved over pulleys 26 and 27. Pulley 26 is mounted on the outer telescopic section 22 and pulley 27 is mounted ont the inner telescopic section 23. At point 28 hose 25 is attached to the inner telescopic section 23.

It is essential that outer telescopic section 22 move at one half the speed of inner telescopic section 23 so that no substantial tension is applied to hydraulic hose 25. The correct relative speed between the outer telescopic section 22 and the inner telescopic section 23 is maintained by chain 52 which is attached between the inner telescopic section 22 and the mast mainframe 21 and it passes over pulley 50 which is mounted on the outer telescopic section 22.

The general structure described above was known prior to the present invention, and it is available in commercially available lift trucks. No further detail concerning the above general structure will therefore be given.

The present invention is directed to the particular structure and position of chain 52 with respect to the other elements in the mast 20. Utilizing the present invention, the chain 52 is mounted in a novel way that allows the truck to be shorter than was possible with the prior art. Saving several inches in the length of a lift truck is highly significant in that it shortens the turning radius of the lift truck thereby allowing it to either work in a smaller space or allowing it to increase productivity if operating in the same size space.

Figure 4:
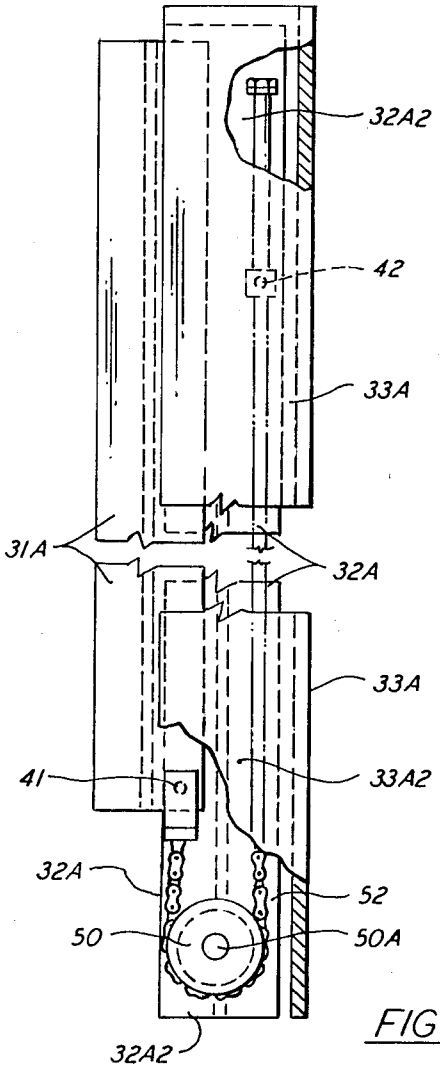
FIG. 4 is a cut away view showing the chain which interconnects the telescopic sections.
Figure 3:
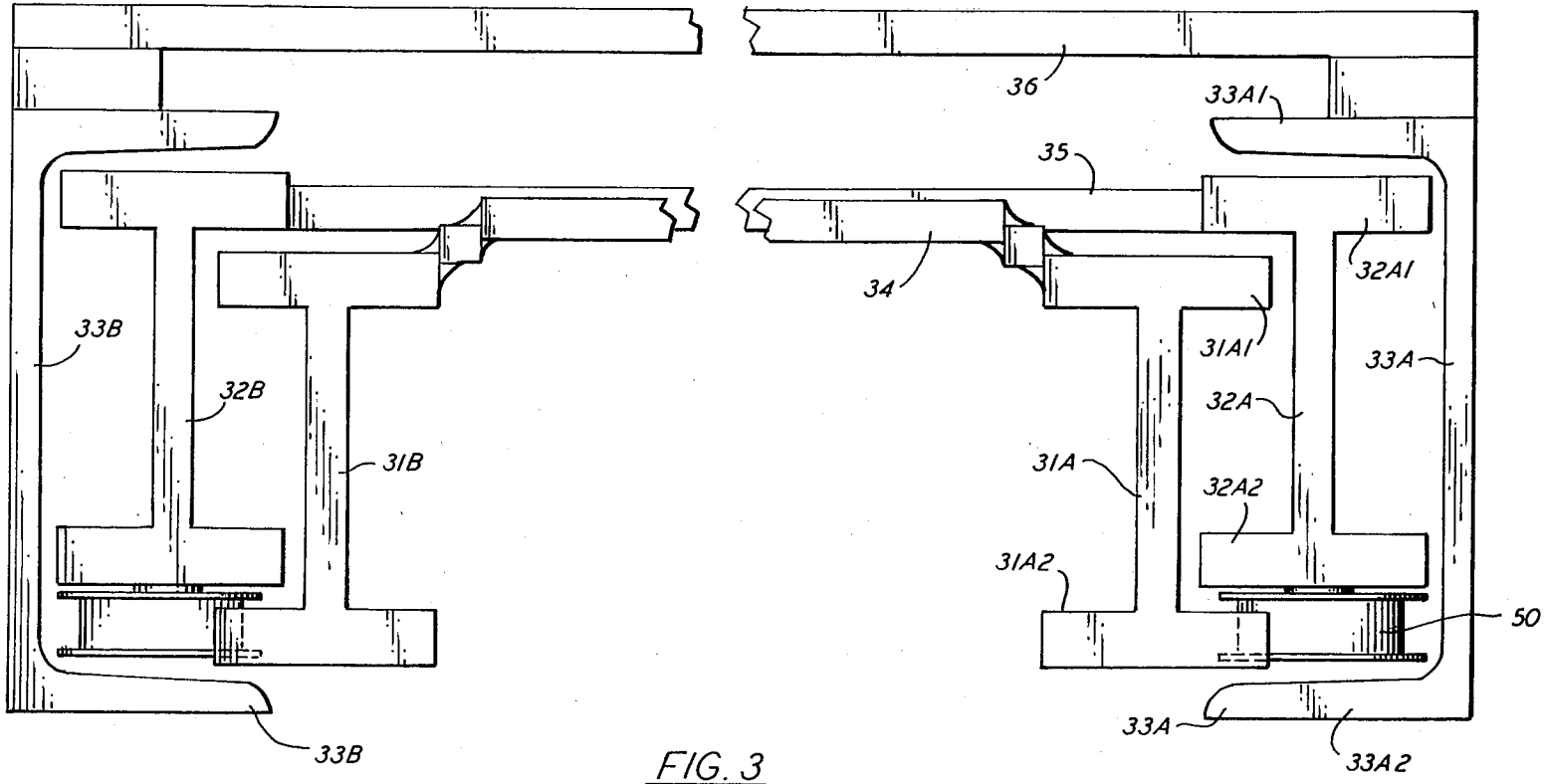
FIG. 3 is a top view showing the cross-section of the mast structure and the location of the chain which interconnects the mast sections.
Figure 5:
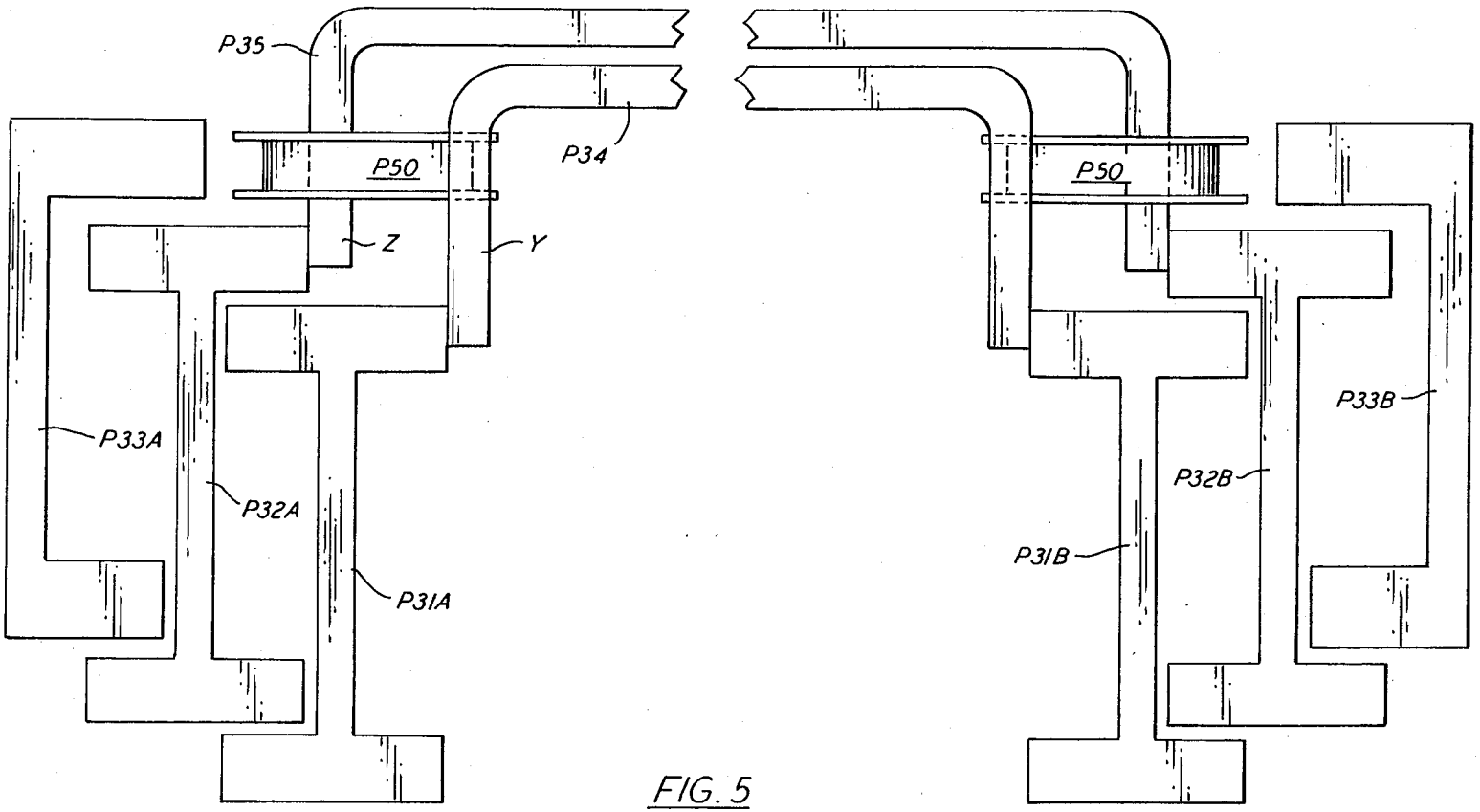
FIG. 5 Prior Art
FIG. 5 is a top view of a prior art system showing the cross section of the mast structure and the location of the chain which interconnects the mast sections.

The manner in which chain 52 is mounted in mast 20 is shown in FIGS. 3 and 4. A prior art technique for mounting this chain is shown in FIG. 5.

FIG. 3 shows a cross section of I-shaped supports 31A and 31B which constitute the support members for the inner telescopic section 23, I-shaped support members 32A and 32B which constitute the support member for the outer telescopic section 22 and "U" shaped members 33A and 33B which are the supports for the base section 21. Members 33A and 33B of base section 21 are wider than members 32A, 32B, 31A and 31B of telescopic sections 22 and 23 since the base section is subjected to more force. Sections 31A and 31B which are on opposite sides of mast 20 are connected by cross bars 34 and sections 32A and 32B are connected by cross bars 35. Sections 33A and 33B are connected by cross bars 36.

The inner telescopic section 23 which includes members 31A, 31B, and 34 is movably supported inside members 23A and 32B in a conventional manner by rollers (which are not shown). Likewise the outer telescopic section 22 which includes members 32A, 32B and 35 is movably supported inside members 33A and 33B of the base section 21 in a conventional manner by rollers (which are not shown). In order to conserve space the endplates 31A1, 32A1 and 33A1 are offset so that the member 31A, 32A and 33A fit into each other. This is conventional.

As can be seen from FIG. 3, pulley 50 which is journalled to support member 32A and is located in front of the end plate 32A2 of I-shaped support member 32A and inside endplate 33A2 of U-shaped member 32A. Being located in this position, the chain 50 does not interfere with cross bars 34, 35 and 36 as the telescopic sections 22 and 23 are moved up and down.

In a prior art system shown in FIG. 5, the pulley P50 which corresponds to pulley 50 in FIG. 3 is located behind, rather than in front of, the support member P31A and P32A. With the system shown in FIG. 5, in order to keep chain 52 from interfering with the cross bars P34 and P35 as the sections 22 and 23 are moved, the cross bars P34 and P35 are "U" shaped rather than being straight as are cross bars 34 and 35 in FIG. 3. The U shaped configuration of cross bars P34 and P35 adds length to the overall length of the vehicle.

The details of how pulley 50 and chain 52 are attached to members 31A and 32A are shown in FIG. 4. Pulley 50 is journalled to "I" member 32A by a pin and bearing 50A. Chain 52 is attached to member 33A by pin 42 and to member 31A by pin 41.

The invention accordingly comprises the features of construction, combination of elements, and arrangement of parts, which will be exemplified in the constructions hereinafter set forth, and the scope of the invention will be indicated in the claims.

I claim:

1. A lift truck with an improved telescopic mast structure comprising:

a U shaped mast base mainframe section, an I shaped outer telescopic mast section movably positioned inside said U shaped mast base section, an I shaped inner telescopic mast section movably positioned inside said outer telescopic mast section, a fork carriage mounted on said inner telescopic section, a hydraulic cylinder on said fork carriage, hydraulic hoses connected to said base mainframe section and to said cylinder, said hoses being reeved to move with said mast sections, a chain connecting the inner and outer telescopic sections so that inner telescopic section moves at twice the speed of the outer telescopic section, said chain being located inside said U shaped channel element that forms the mast mainframe and in front of the I member of the outer telescopic section and alongside of the front part of the I member of the inner telescopic section, whereby the chain is in a protected location and it does not add any length to the truck.

2. The combination recited in claim 1 wherein said hoses are reeved over a pulley mounted on top of said outer telescopic section and attached to the bottom of said inner telescopic section.

3. The combination recited in claim 2 wherein said hoses are reeved over a pulley attached to the top of said inner telescopic section and attached to the bottom of said carriage.

4. The combination recited in claim 1 wherein said chain is attached to the bottom of said inner telescopic section and to the top of said mast mainframe, and wherein said chain passes over a pulley that is mounted on the bottom of said outer telescopic section.

5. The combination recited in claim 1 wherein there are two chains connecting the mast sections, one on each side of the mast.

6. A lift truck with an improved telescopic mast structure comprising:

a U shaped mast base mainframe section, an I shaped outer telescopic mast section movably positioned inside said mast base section, the legs of said I shaped member outer telescopic member being positioned inside the legs of said U shaped mast base mainframe section, an I shaped inner telescopic mast section movably positioned inside said outer telescopic mast section, the legs of said I shaped inner telescopic section positioned offset from the legs of said I shaped outer telescopic section, a fork carriage mounted on said inner telescopic section, a hydraulic cylinder on said fork carriage, hydraulic hoses connected to said base mainframe section and to said cylinder, said hoses being reeved to move with said mast sections, a chain connecting the inner and outer telescopic sections so that inner telescopic section moves at twice the speed of the outer telescopic section, said chain being located inside said U shaped channel element that forms the mast mainframe and in front of the I member of the outer telescopic section and alongside of the front part of the I member of the inner telescopic section, whereby the chain interconnecting the telescopic sections is protected and it does not add any length to said truck.

* * * * *